US006526797B2

(12) United States Patent
Matsuoka

(10) Patent No.: US 6,526,797 B2
(45) Date of Patent: Mar. 4, 2003

(54) NEGATIVE-ANGLE FORMING DIE

(75) Inventor: Mitsuo Matsuoka, Hirakata (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/875,100

(22) Filed: Jun. 7, 2001

(65) Prior Publication Data

US 2002/0124619 A1 Sep. 12, 2002

(30) Foreign Application Priority Data

Mar. 5, 2001 (JP) ..... 2001-060153

(51) Int. Cl.[7] ..... B21D 5/04
(52) U.S. Cl. ..... 72/312; 72/387; 72/452.9
(58) Field of Search ..... 72/312–315, 319, 72/387, 388, 452.9

(56) References Cited

U.S. PATENT DOCUMENTS

| | | | | |
|---|---|---|---|---|
| 4,365,500 A | * | 12/1982 | Klukow | 72/387 |
| 4,434,644 A | * | 3/1984 | Gargrave et al. | 72/387 |
| 5,746,082 A | * | 5/1998 | Matsuoka | 72/313 |
| 5,784,916 A | * | 7/1998 | Matsuoka | 72/313 |
| 6,038,908 A | * | 3/2000 | Kinoshita | 72/313 |
| 6,196,040 B1 | * | 3/2001 | Matsuoka | 72/315 |
| 6,230,536 B1 | * | 5/2001 | Matsuoka | 72/313 |

FOREIGN PATENT DOCUMENTS

| | | | |
|---|---|---|---|
| JP | 11-226672 | * | 8/1999 |
| JP | 2000-51948 | * | 2/2000 |

* cited by examiner

*Primary Examiner*—Daniel C. Crane
(74) *Attorney, Agent, or Firm*—Birch, Stewart, Kolasch & Birch, LLP

(57) ABSTRACT

The present invention provides a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, positioning means for fixing an axial position of the rotary cam being provided in the lower die half and the rotary cam.

4 Claims, 10 Drawing Sheets

NEGATIVE-ANGLE FORMING DIE

BACKGROUND OF THE INVENTION

The present invention relates to a negative-angle forming die for forming a sheet metal. Herein, the negative-angle forming die is used for a formation made at a location more inward of a lower die half than a straight downward stroke line of an upper die half.

The negatively angled forming of a work provided as a sheet metal into a shape having a portion more inward of the lower die half than the straight downward stroke line of the upper die half is generally performed by using a slide cam.

According to a prior-art intrusion forming process of the sheet metal work, the work is placed on the lower die half and the upper die half is lowered vertically. At this time a drive cam of the upper die half drives a driven cam of the lower die half, forming the work from a side. After the formation is completed and the upper die half is lifted, then the driving cam is retracted by a spring.

In the above arrangement, the driven cam slid onto the work from the side has a forming portion which is formed as a single piece in the same shape as the work as after the formation. The lower die half however, must allow the work to be taken out from the lower die half after the formation, and for this reason, a portion of the lower die half providing the intrusion formation must be made separable for retraction, or a rear portion thereof must be cut off so that the work can be moved forward and taken out. This does not pose a serious problem if the extent of the intrusion is small. However, the problem becomes serious if the extent of the intrusion is large, or if the work is to be formed into a long frame having a groove-like section such as in a formation of an automobile front pillar-outer from a sheet metal. Specifically, since the groove width of the work is so narrow, that if the portion of the lower die half corresponding to the groove is divided or cut off, it becomes impossible for the forming portion of the driven cam to form clearly. In addition, strength of the lower die decreases. Thus, it was impossible to perform a clear-shaped intrusion formation.

Further, a formed product sometimes has a twist or distortion, which must be corrected. However, for example, many automobile parts that provide the outer skin of the automobile, such as a side panel, fender, roof, bonnet, trunk lid, door panel, front pillar-outer and so on are formed to have a three-dimensional surface or line, and therefore it is practically impossible to make correction after the formation. In assembling the automobile sheet-metal parts, if there is a twist or distortion in the parts, it is difficult to fit the parts together. Without solving this problem, it was impossible to provide a high quality automobile sheet metal structure, and it was impossible to maintain a required level of product accuracy in the formed sheet metal products.

In order to solve the above-described problem, an arrangement was proposed, in which the straight downward stroke of the upper die half is converted to a rotary movement of a rotary cam to pivot to form the portion in the lower die half more inward than the straight downward stroke line of the upper die half. In this arrangement, after the forming operation, the rotary cam is pivoted back to a state where the completed work can be taken out of the lower die. This arrangement will be described in more detail.

Specifically, as shown in FIG. 9 to FIG. 12, this negative-angle forming die comprises a lower die half 102 including a supporting portion 101 on which a work W is placed and an upper die half 103 which is lowered straightly down onto the lower die half 102 to press thereby forming the work W. The lower die half 102 is rotatably provided with a rotary cam 106 supported in an upwardly opening axial groove 104. The groove 104 has a portion close to the supporting portion 101 formed with an intrusion forming portion 105 located more inward than a stroke line of the upper die half 103. The lower die half 102 rotatably supports a rotary cam 106. The upper die half 103 is provided with a slide cam 108 opposed to the rotary cam 106 and provided with an intrusion forming portion 107. The lower die half is further provided with an automatic retractor 109 which moves the rotary cam 106 back to the sate that allows the work W to be taken out of the lower die half 102 after the formation. The work W placed on the supporting portion 101 of the lower die half 102 is formed by the intrusion forming portion 105 of the rotary cam 106 and the intrusion forming portion 107 of the slide cam 108. The work W is formed by a rotary movement of the rotary cam 106 and a sliding movement of the slide cam 108. After the formation, the automatic retractor 109 pivots back the rotary cam 106, allowing the work W to be taken out of the lower die half 102.

Now, an operation of this negative-angle forming die will be described.

First, as shown in FIG. 9, the upper die half 103 is positioned at its upper dead center. At this stage, the work W is placed on the supporting portion 101 of the lower die half 102. The rotary cam 106 is held at its retracted position by the automatic retractor 109.

Next, the upper die half 103 begins to lower, and first, as shown in FIG. 10, a lower surface of the slide cam 108 makes contact with a pivoting plate 111 without causing the slide cam 108 to interfere with the intrusion forming portion 105 of the rotary cam 106, pivoting the rotary cam 106 clockwise as in FIG. 10, thereby placing the rotary cam 106 at a forming position. Then, a pad 110 presses the work W.

When the upper die half 103 continues to lower, the slide cam 108 which is under an urge outward of the die half begins a sliding movement as the sliding cam in a laterally leftward direction, against the urge from a coil spring 112. This is a state shown in FIG. 11, where the intrusion forming portion 105 of the pivoted rotary cam 106 and the intrusion forming portion 107 of the slide cam 108 perform formation of the work W.

After the intrusion formation, the upper die half 103 begins to rise. The slide cam 108, which is urged outwardly of the die half by the coil spring 112, moves in a laterally rightward direction as in FIG. 12, and keeps rising without interfering with the work W as after the intrusion formation. On the other hand, the rotary cam 106 is released from the holding by the slide cam 108, and therefore is pivoted in a leftward direction as in FIG. 12 by the automatic retractor 109. Thus, when the work W is taken out of the lower die half after the intrusion formation, the work W can be removed without interference with the intrusion forming portion 105 of the rotary cam 106.

According to the negative-angle forming process described above, the lower surface of the slide cam 108 urged by the coil spring 112 contacts the pivoting plate 111 urged by the coil spring 113 of the automatic retractor 109, rotating the rotary cam 106 in the clockwise direction to the shaping position, and thereafter, the pad 110 presses the work W. With this arrangement, urging force from the pad 110 to the work W is so strong that the work W under the formation can be slightly pivoted counterclockwise as in the figure. In another case, the urge of the coil spring 112 of the slide cam 108 is not well balanced with the urge of the coil spring 113 of the automatic retractor 109, resulting in a slight pivoting movement of the rotary cam 106 out of the predetermined position for the formation. These situations sometimes make impossible to form into an accurate curve. For example, it is sometimes impossible to provide a product of an accuracy level in the order of 1/100 mm, and it was sometimes impossible to achieve a high quality negative-angle formation.

Further, as will be understood from FIG. 9 through FIG. 12, the rotary cam 106 is supported by the lower die half 102 through direct contact of the cam's outer circumference except for the groove portion 104. With this structure, accurate and difficult machining must be made to the rotary cam 106 and the supporting portion (a bore having a generally circle section) of the lower die half 102 which supports the rotary cam 106.

Further, since most of the outer wall of the rotary cam 106 is used for support by the lower die half 102, the negative angle forming die tends to be large and expensive.

Now, in consideration of the background described above, the present invention aims to solve these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. The present invention aims to maintain the rotary cam at a predetermined forming position thereby providing a formed sheet metal product of a high quality. In order to achieve this object, the present invention provides a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, positioning means for fixing an axial position of the rotary cam being provided in the lower die half and the rotary cam.

Further, in consideration of the background described above, the present invention aims to solve these problems: that slight pivoting movement makes a rotary cam out of a predetermined forming position, making an unwanted step in a curved surface of the work or making unable to form into an accurate curve; and it is difficult to provide a product of accuracy in the order of 1/100 mm is difficult; and that it is impossible to provide a formed sheet metal product of a high quality. The present invention aims to minimize the unwanted movement of the rotary cam at the time of the intrusion formation and maintain the rotary cam at a predetermined forming position, thereby providing a formed sheet metal product of a high quality. In order to achieve this object, the present invention provides a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a backup portion being formed in the lower die half for supporting a surface of the rotary cam on a side away from a side receiving the slide cam.

Further, the present invention does not rely on the multi-diameter rotary cam in a case in which there is a large variation in the distance of the intrusion forming portion from the axis. Specifically, the present invention provides a negative-angle forming die, wherein the intrusion forming portion varies a pressing side-portion of the rotary cam contacted by the backup portion in accordance with a distance from an axis of pivoting.

EMBODIMENT

The present invention will now be described in detail, based on an embodiment shown in the attached drawings.

Figure 1A:
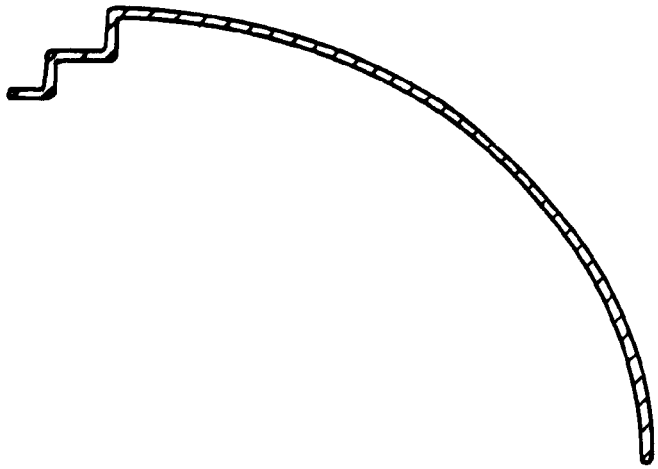
[FIGS. 1(*a*) and 1(*b*)] Two sectional views of an automobile sheet-metal part before and after a formation by the negative-angle forming die according to the present invention.
Figure 1A:
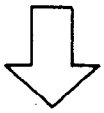
Figure 1B:
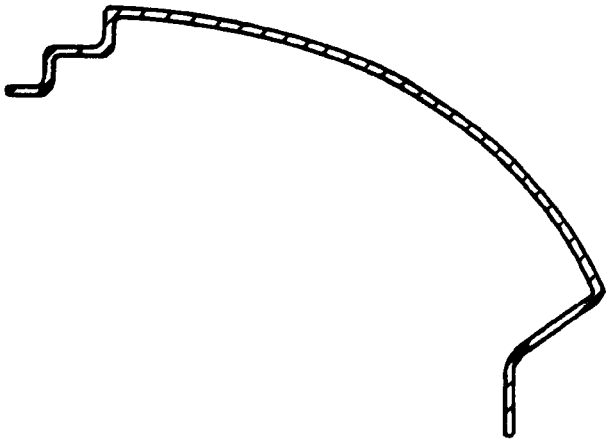

FIG. 1 shows sectional views of an automobile sheet-metal part before and after a formation by the negative-angle forming die. A work W shown in FIG. 1(*b*) has a lower portion shaped by an intrusion forming process.

It should be noted here that this part is formed to have a three-dimensional curved surface/line to provide an outer skin of the automobile.

Figure 2:
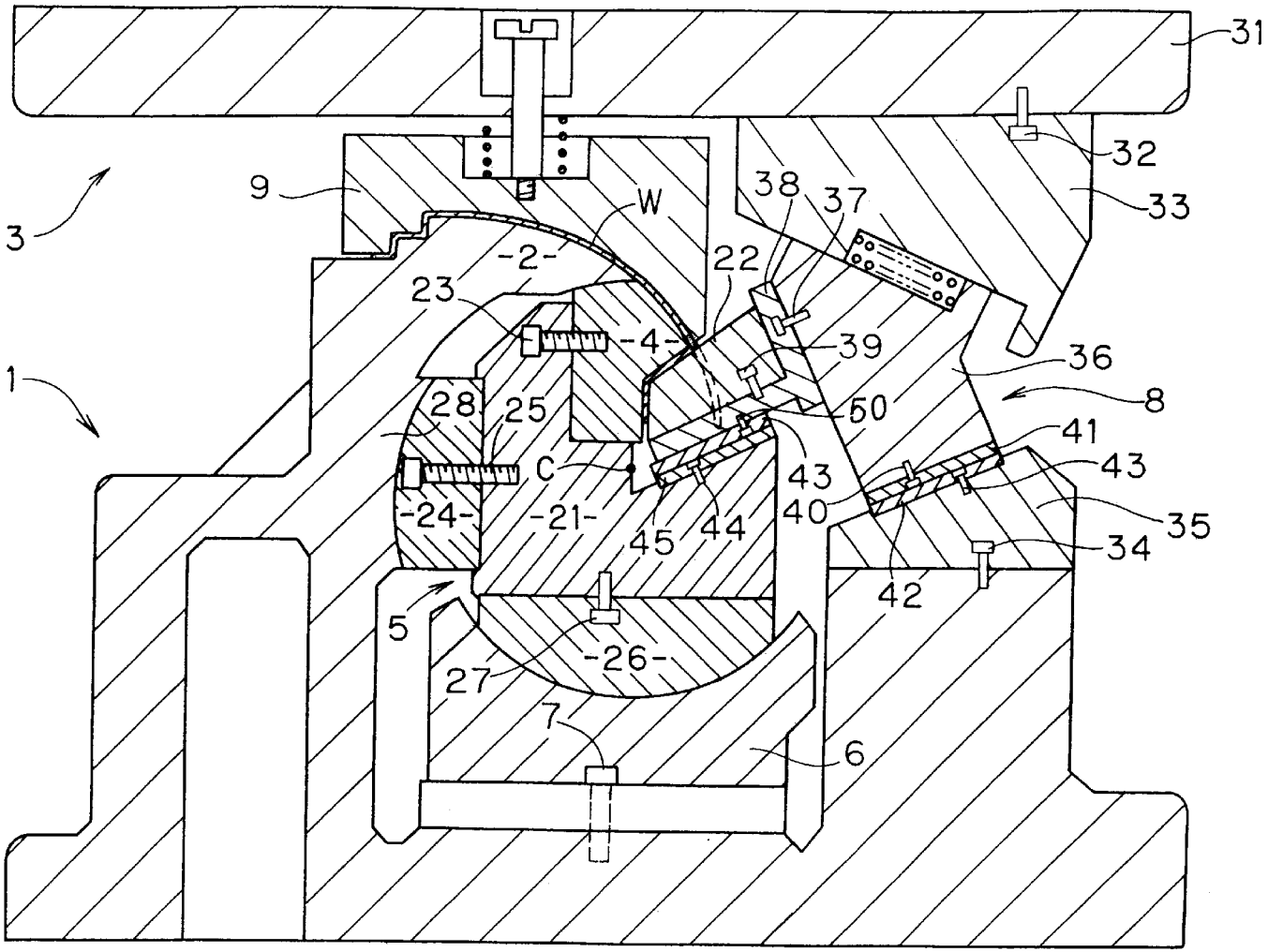
[FIG. 2] A sectional side view showing a state where an upper die half forming the sheet-metal part in FIG. 1 has been lowered to a lower dead center.

Referring now to FIG. 2, a lower die half 1 has an upper portion formed with a supporting portion 2 for the work W. The lower die half 1 rotatably supports a rotary cam 5, which has a side close to the supporting portion 2, formed with an intrusion forming portion for forming a recessed portion located inward of a stroke line of an upper die half 3. Code C indicates a center of pivoting movement of the rotary cam 5. In order to take the work W out of the lower die half 1 after the work W has been formed, the lower die half 1 is provided with an unillustrated automatic retractor such as an air cylinder. The rotary cam 5 is supported by a pivot-supporting member 6 fixed to the lower die half by a bolt 7.

The upper die half 3 is provided with a slide cam 8 and a pad 9.

Figure 3:
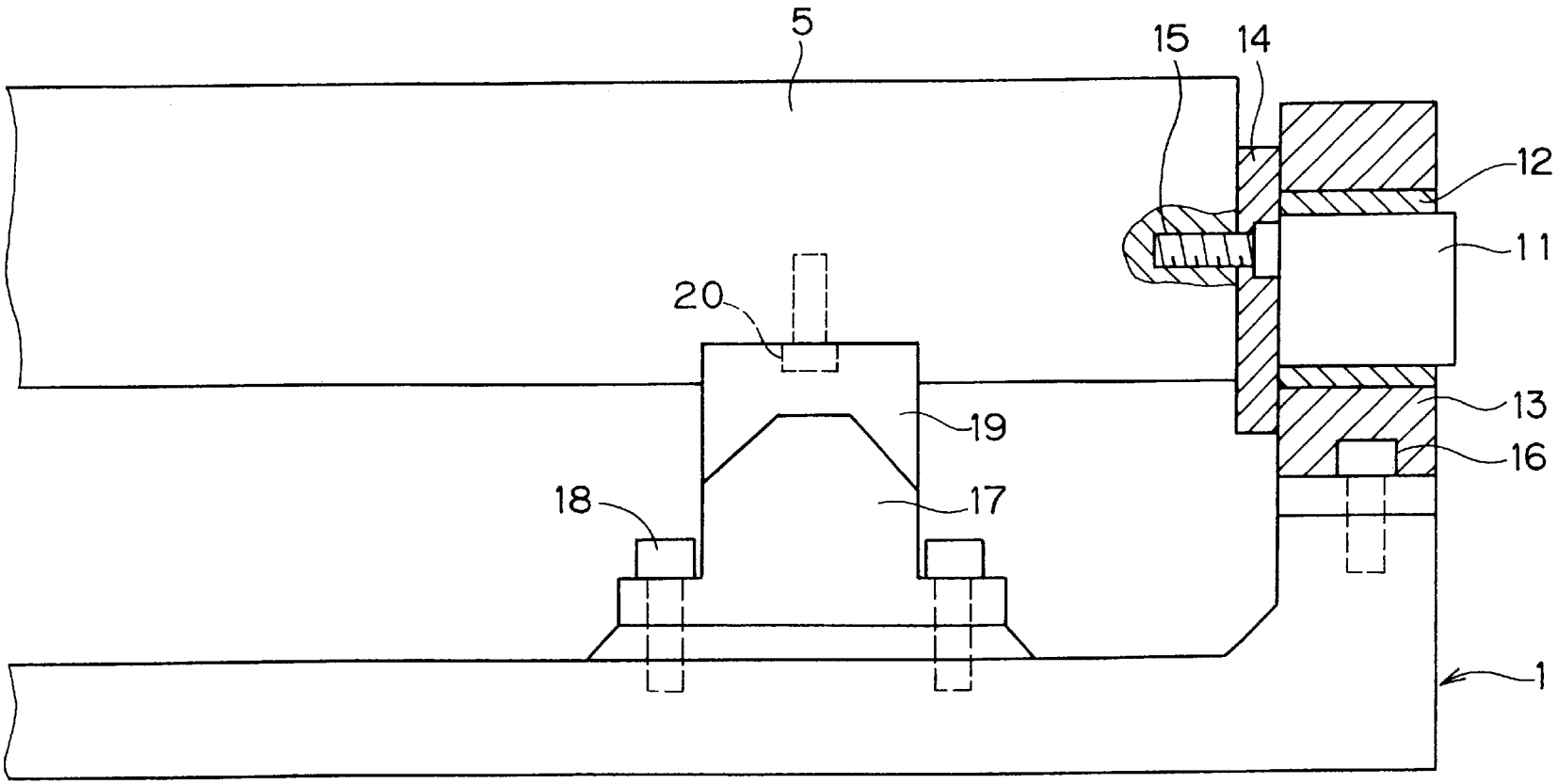
[FIG. 3] A conceptual diagram showing support and positioning of a rotary cam according to the present invention.

In order to maintain the rotary cam at a predetermined axial position thereby providing a high quality sheet-metal product, as shown in FIG. 3, the lower die half 1 and the rotary cam 5 are provided with positioning means for fixing the axial position of the rotary cam 5. FIG. 3 is a conceptual diagram of the positioning means.

The shaft-like rotary cam 5 has two ends each provided with a supporting shaft 11 extending therefrom. Each of the supporting shafts 11 is fitted into a tubular metal 12 fixed to a bearing 13. The metal 12 rotatably supports the rotary cam 5. The supporting shaft 11 has a base plate 14 fixed by a bolt to the end of the rotary cam 5. The bearing 13 to which the supporting shaft 11 is fitted is fixed to the lower die half 1 by a bolt 16.

The rotary cam 5 is supported at its ends by the bearings 13 as described above. If the rotary cam is directly contacted with the lower die half as in the prior art, accurate machining is required. However, since most portion of the rotary cam 5 is not directly contacted with the lower die half 1, machining of the rotary cam 5 and the lower die half 1 becomes easy.

In order to fix the axial position of the rotary cam 5, an axial positioning block 17 is fixed to the lower die half 1 by a bolt 18. The positioning block 17 is opposed by a receiving block 19 fixed on the rotary cam 5 by a bolt 18, to be fitted by the positioning block 17 for positioning the rotary cam 5 at a predetermined position. With this arrangement, even if the rotary cam 5 receives an axial load during the pressing operation, the rotary cam 5 is prevented from axial movement by the engagement between the receiving block 19 and the positioning block 17. According to this embodiment, the positioning block 17 is formed convex, whereas the receiving block 17 is formed concave. The present invention is not limited by this however. For example, the positioning block may be made concave and the receiving block may be made convex. Further, these still do not limit the present invention. For example, a movement prevention wall may be provided at a position capable of preventing the rotary cam from unwanted movement during the forming operation. It should be noted here that according to the present embodiment, the positioning block 17 of the lower die half is made convex for ease of use because this arrangement allows dirt, oil and so on to fall easily.

Figure 4:
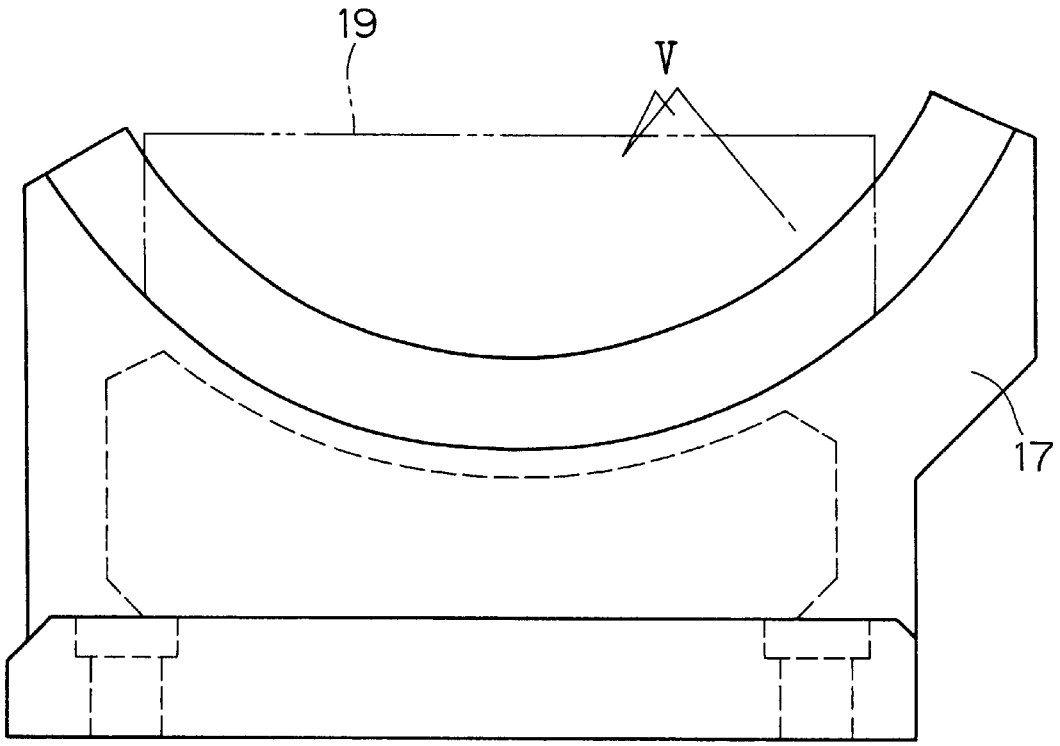
[FIG. 4] A front view of a positioning block as an example of positioning means according the present invention.
Figure 5:
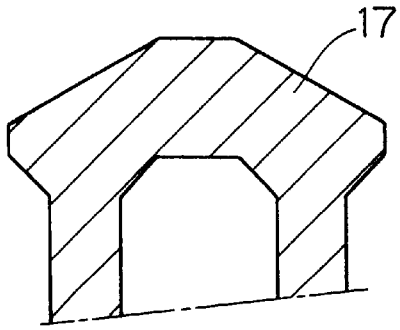
[FIG. 5] A view en from a direction indicated by Arrow V in FIG. 4.
Figure 6:
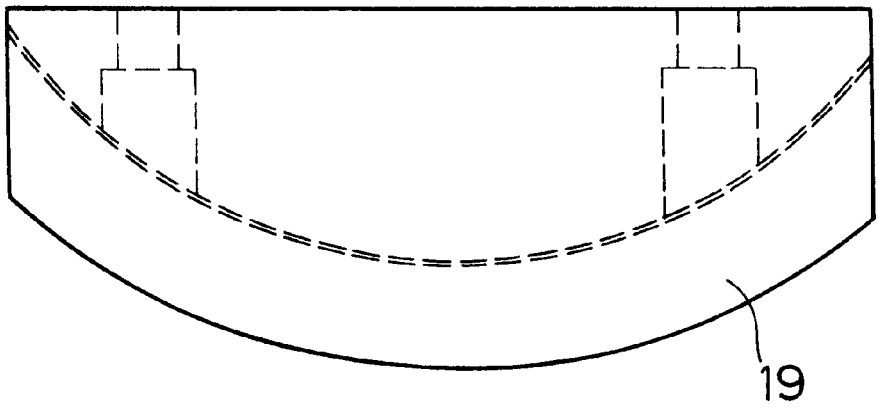
[FIG. 6] A front view of a receiving block as an example of the positioning means according to the present invention.
Figure 7:
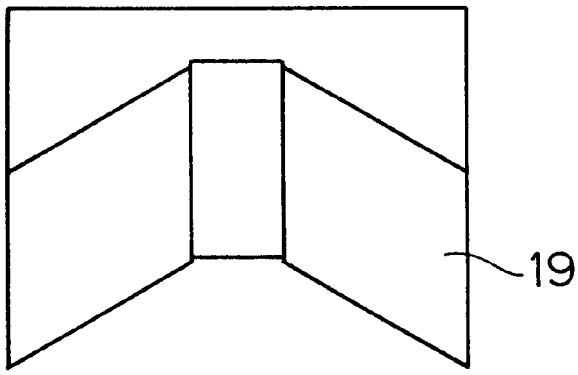
[FIG. 7] A side of the receiving block in FIG. 6.

FIG. 4 and FIG. 5 show the positioning block 17, whereas FIG. 6 and FIG. 7 show the receiving block 19. Since the rotary cam 5 is generally columnar, the positioning block 17 is formed to have an arcuate recess to fit the columnar outer circumference of the rotary cam 5, whereas the receiving block 19 is formed to fit the positioning block 17.

The rotary cam 5 is rotatably supported at its end portions by the bearings 13. Differing from the prior art in which the lower die half 1 supports by using most of the outer circumference of the rotary cam 5, as shown in FIG. 2, the support is provided by partial contact.

The rotary cam 5 includes a rotary cam main body 21 serving as a core portion having; an upper portion provided with an intrusion forming portion 4 fixed by a bolt 23, a side portion provided with a pressing side-member 24 fixed by a bolt 25, and a bottom portion provided by a pivoting contact member 26 fixed by a bolt 27.

The rotary cam 5 not only has the pivoting contact member 26 contacting the pivoting support member 6 but also has the pressing side-member 24 contacting a backup portion 28 of the lower die half 1. With this arrangement, when the intrusion forming portion 4 of the rotary cam 5 and the intrusion forming portion 22 of the slide cam 8 press the work W, the backup portion 28 contacts the pressing side-member 24 thereby preventing the rotary cam 5 from deformation. By providing the backup portion 28, the deformation of the rotary cam 5 can be positively prevented, and it becomes possible to manufacture a high-quality sheet-metal formed product.

The slide cam 8 slides on an actuator cam 33 fixed to an upper-die-half base plate 31 by a bolt 32, and further slides on a cam base 35 fixed to the lower die half 1 by a bolt 34.

The slide cam 8 holds the intrusion forming portion 22 fixed by a bolt 39 to a bracket 38 fixed to a base portion 36 by a bolt 37.

In the base portion 36 of the slide cam 8, a wear plate 41 fixed by a bolt 40 slides on a wear plate 42 fixed to the cam base 35 by a bolt 43.

Further, a wear plate 43 fixed to a lower surface of the bracket 38 by a bolt 50 slides on a wear plate 45 fixed by a bolt 44 to the rotary cam main body 21 of the rotary cam 5.

Figure 8:
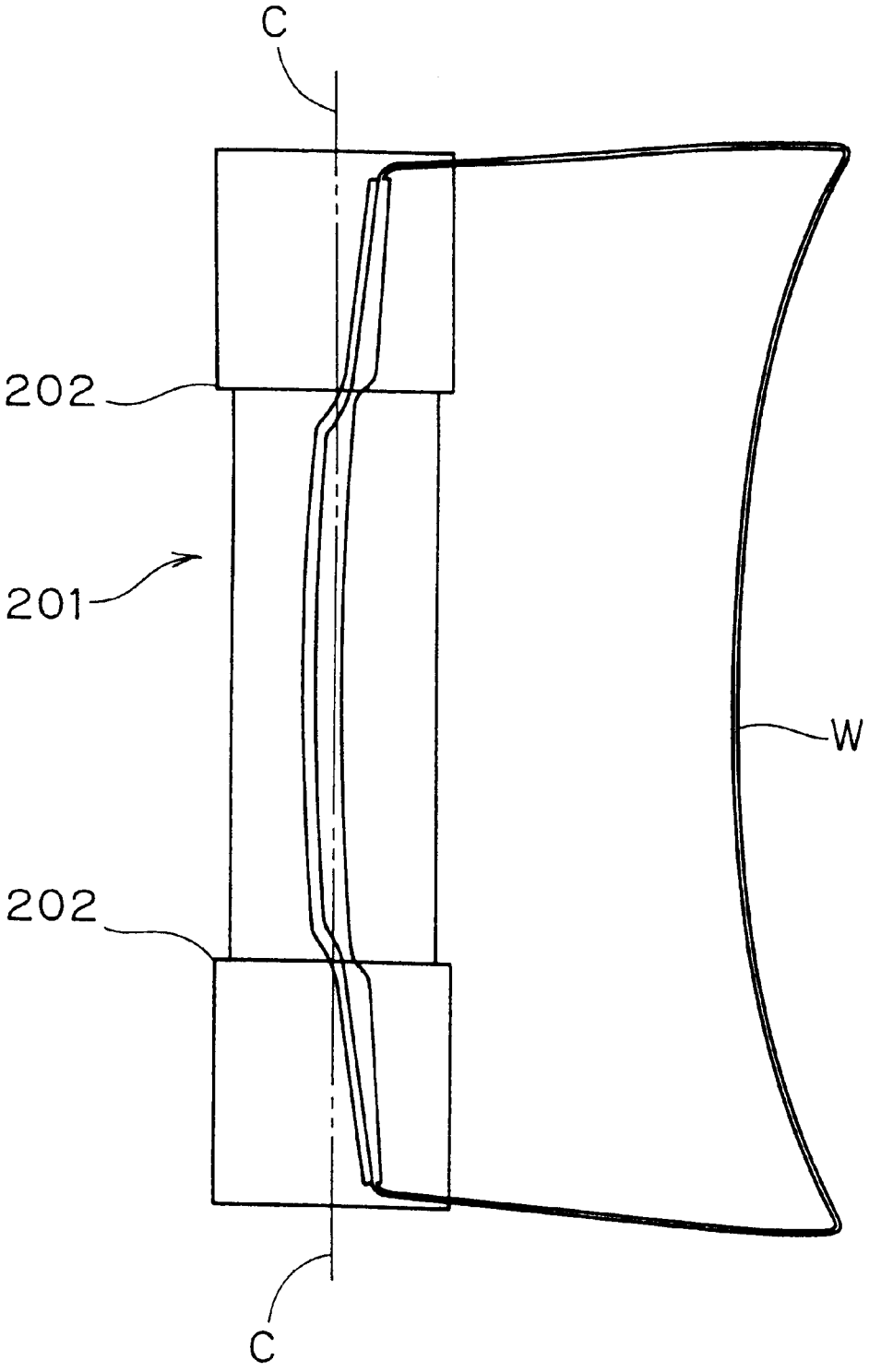
FIG. 8 BACKGROUND ART
[FIG. 8] A plan view of a prior art multi-diameter rotary cam used in a prior art in a case where a distance from a rotary cam axis varies widely.
Figure 9:
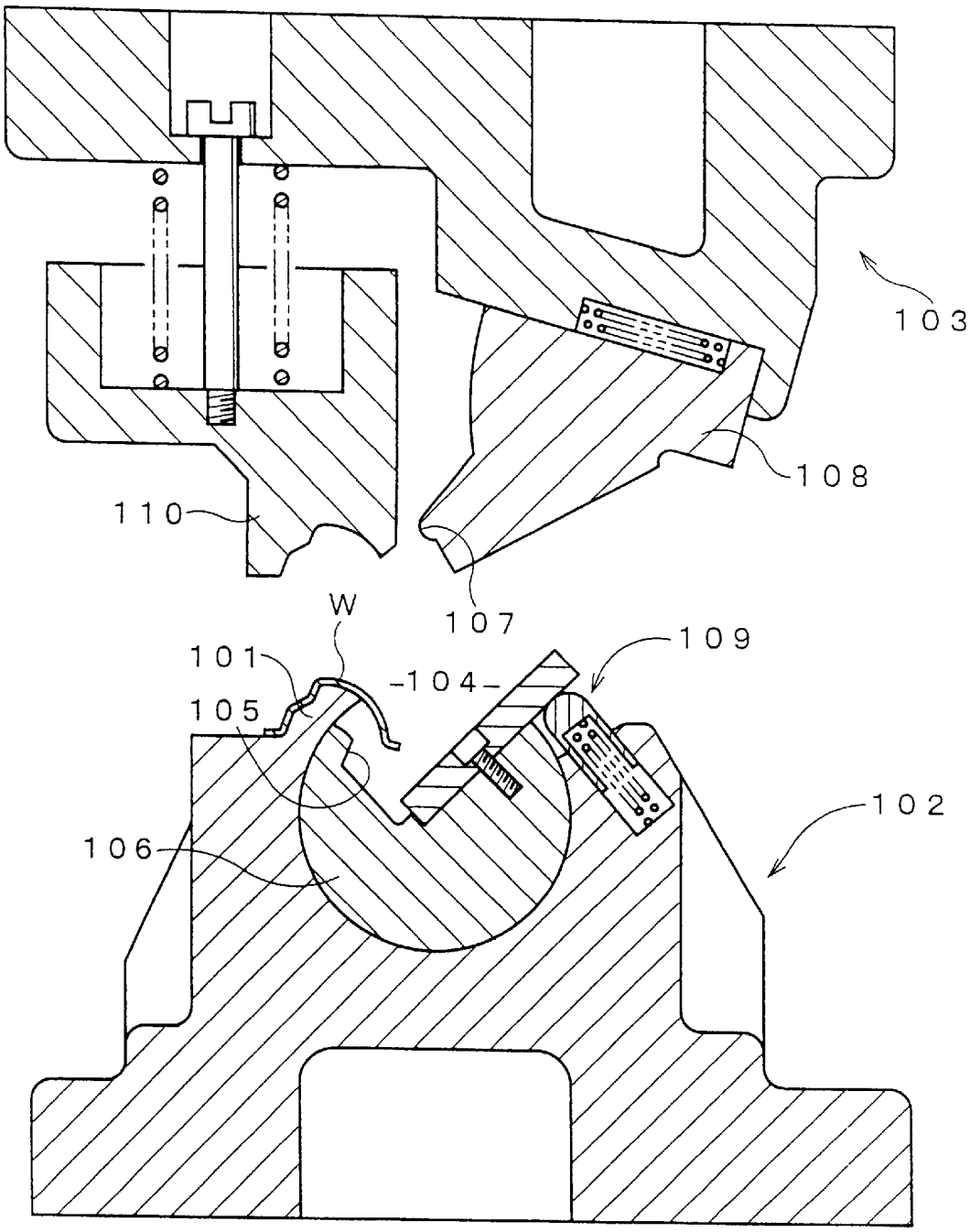
FIG. 9 BACKGROUND ART
[FIG. 9] A sectional side view of a prior art negative-angle forming die, with an upper die half thereof being at its upper dead center.
Figure 10:
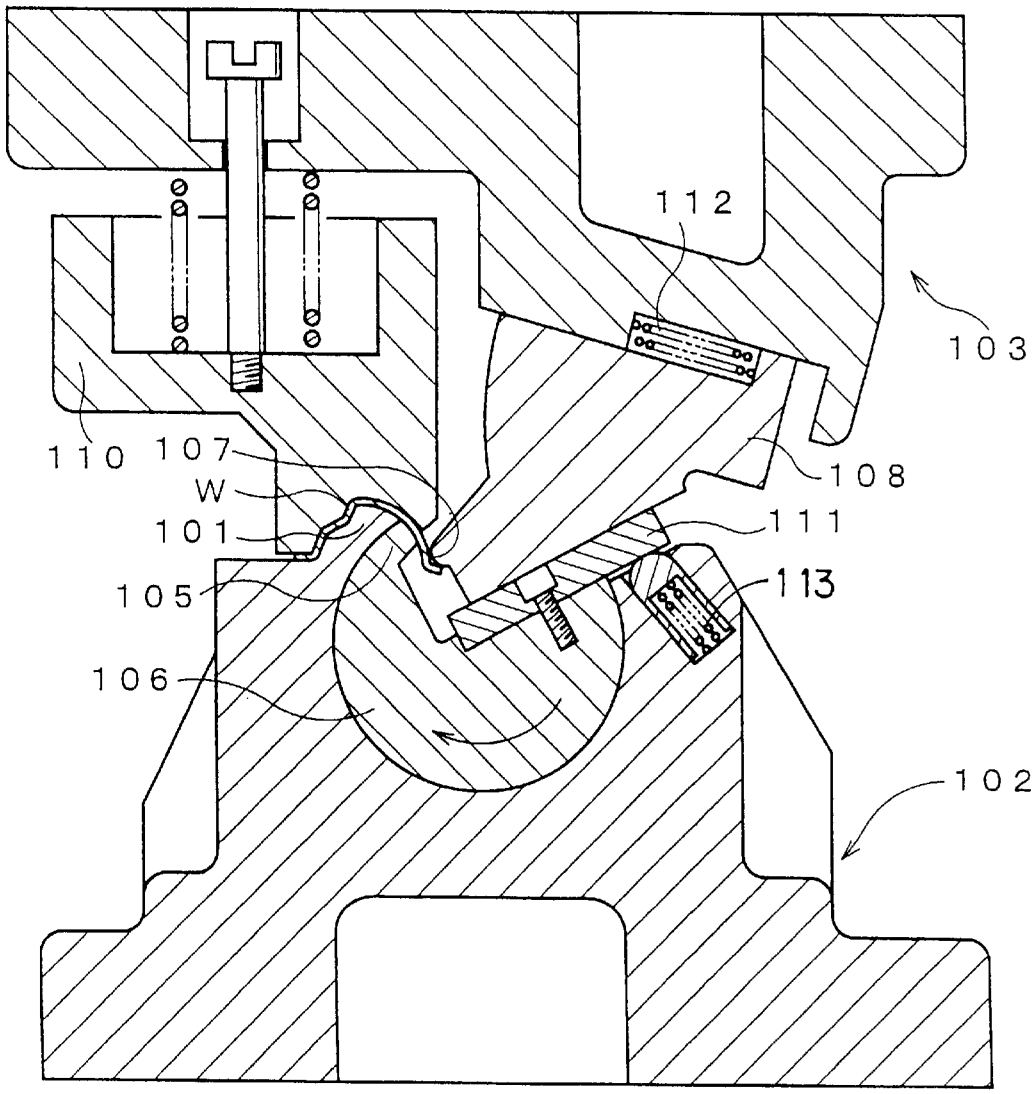
FIG. 10 BACKGROUND ART
[FIG. 10] A sectional side view of the prior art negative-angle forming die in FIG. 9, with the upper die half in its downward stroke, beginning to contact a lower die half thereby making contact with a work.
Figure 11:
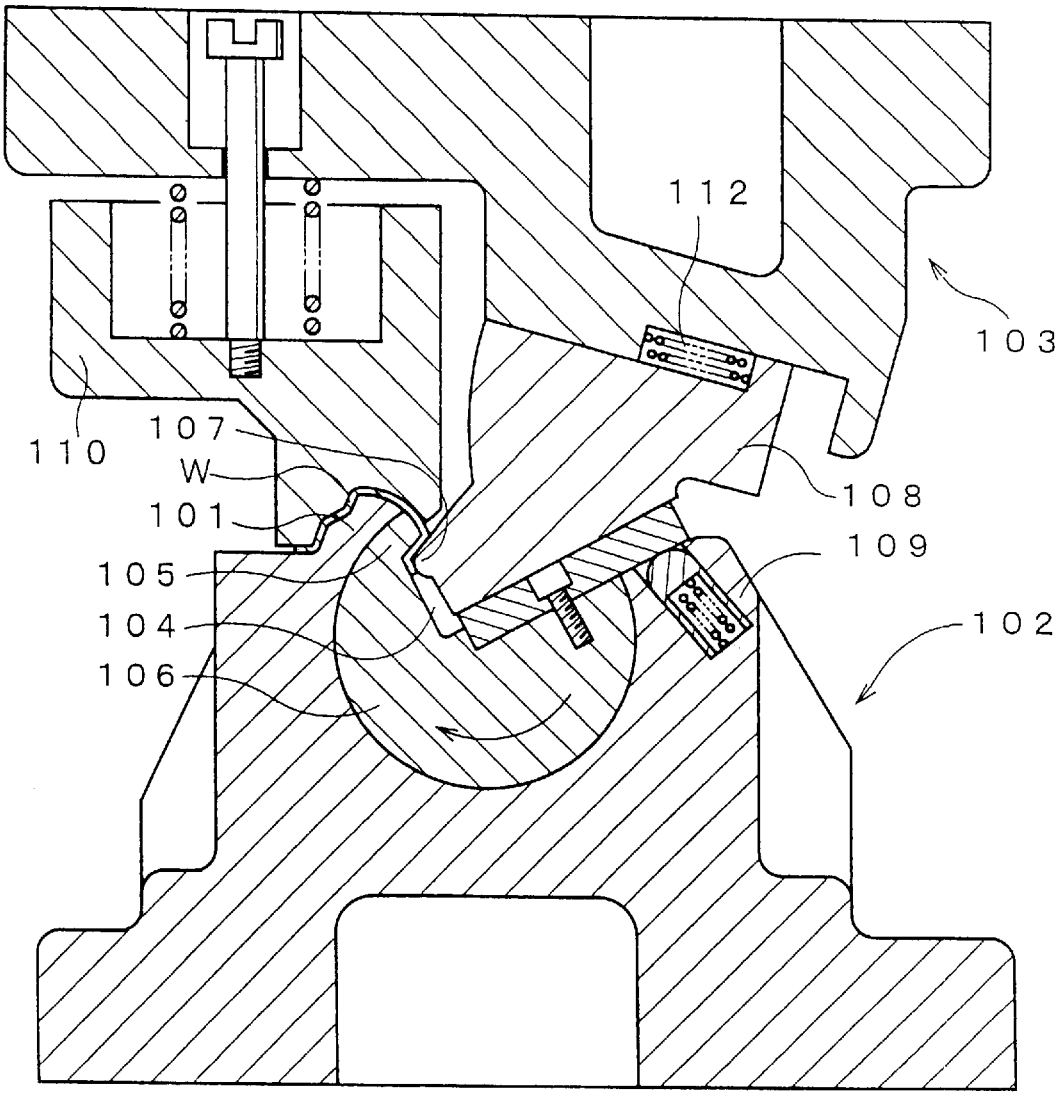
FIG. 11 BACKGROUND ART
[FIG. 11] A sectional side view,of the prior art negative-angle forming die in FIG. 9, with the upper die half being at its lower dead center.
Figure 12:
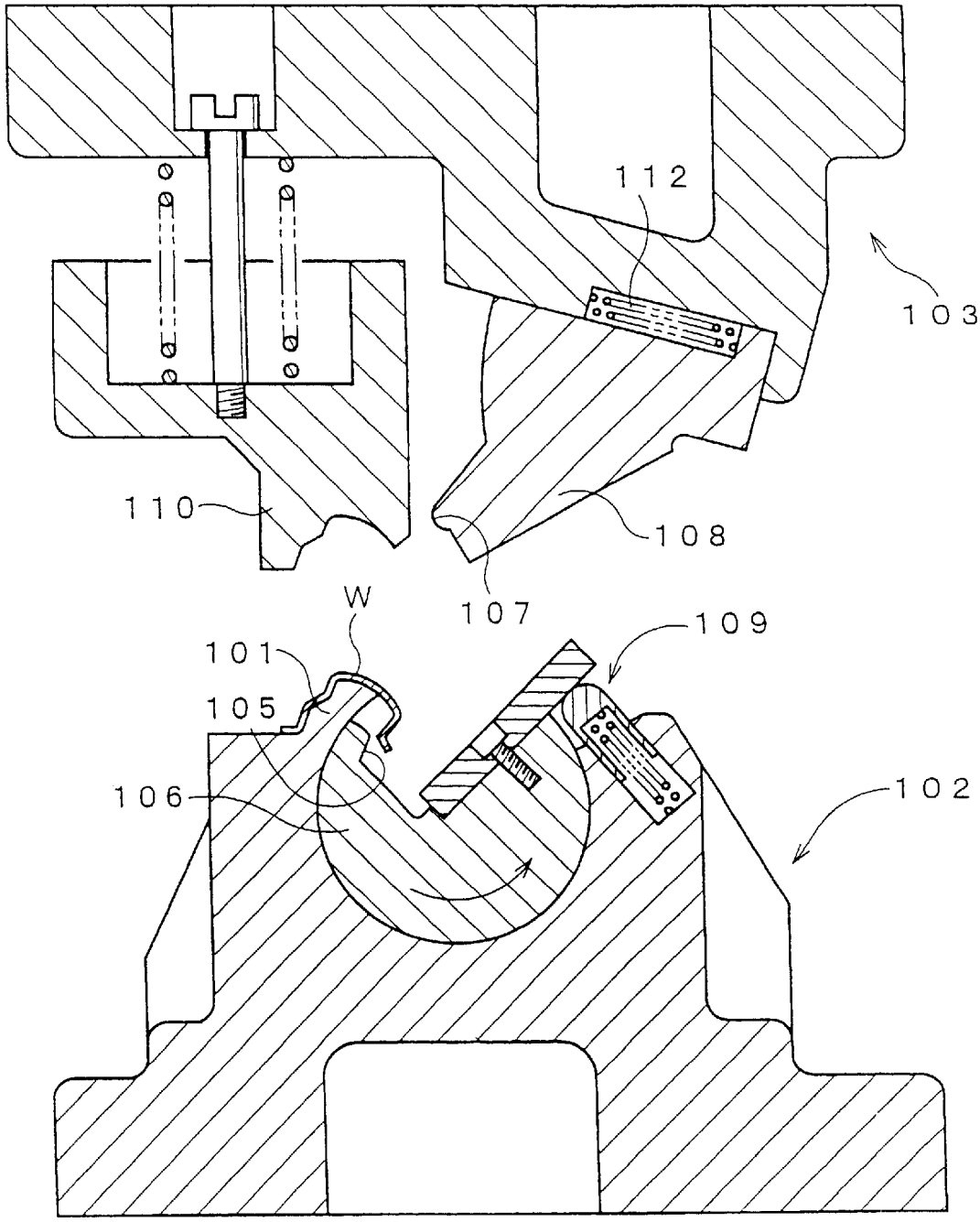
FIG. 12 BACKGROUND ART
[FIG. 12] A sectional side view of the prior art negative-angle forming die in FIG. 9 as after the intrusion forming, with the upper die half lifted to its upper dead center.

When forming a negative angle in a work, generally, a distance of the intrusion forming portion from the pivot axis varies along the axis. This poses no problem as long as the distance of the intrusion forming portion from the axis is small. However, if the distance is large as shown in FIG. 8, a multi-diameter rotary cam 201 having different diameters along the axis is used. The multi-diameter rotary cam 201 has angled edges 202 which often leave a score in the work W.

In order to solve this problem, according to the present invention, if the distance of the intrusion forming portion from the pivot axis varies widely, no multi-diameter rotary cam is used but the pressing side-member 24 is used in accordance with the distance from the axis. The pressing side-member 24 has a portion gradually varied in accordance with the distance variation from the axis of the intrusion forming portion.

The present invention provides, as has been described, a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, positioning means for fixing an axial position of the rotary cam being provided in the lower die half and the rotary cam. Therefore, the present invention has solved these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. According to the present invention, the rotary cam can be maintained at a predetermined forming attitude, and therefore it has become possible to provide a high-quality sheet-metal formed product.

Further, the present invention provides a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the, intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a backup portion being formed in the lower die half for supporting a surface of the rotary cam on a side away from a side receiving the slide cam. Therefore, the present invention has solved these problems: that slight pivoting movement makes a rotary cam out of a predetermined forming position, making an unwanted step in a curved surface of the work or making unable to form into an accurate curve; that it is difficult to provide a product of accuracy in the order of 1/100 mm is difficult; and that it is impossible to provide a formed sheet metal product of a high quality. According to the present invention, unwanted movement of the rotary cam at the time of the intrusion formation is minimized and the rotary cam can be maintained at a predetermined forming position, therefore it has become possible to provide a high-quality sheet-metal formed product.

Further, according to the present invention, the intrusion forming portion varies a pressing side-portion of the rotary cam contacted by the backup portion in accordance with a distance from an axis of pivoting. Therefore, in the case where the distance of the intrusion forming portion from the axis varies widely, the intrusion forming can be performed without using a multi-diameter cam but by using the pressing side-member in accordance with the distance from the axis, without risk of scoring the work.

What is claimed is:

1. A negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, positioning means for fixing the axial position of the rotary cam, said positioning means comprising an axial positioning block carried by the lower die half and a receiving block carried by the rotary cam, wherein each of the axial positioning block and the receiving block have mating surfaces which when, in contact with each other, prevent axial movement of the rotary cam.

2. A negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein the rotary cam has two ends each including a supporting shaft projecting therefrom, the supporting shafts being supported by the lower die half for rotatably supporting the rotary cam, a backup portion being formed in the lower die half for supporting a surface of the rotary cam on a side away from a slide receiving the slide cam, said forming die further comprising positioning means for fixing the axial position of the rotary cam, said positioning means comprising:

a receiving block fixedly carried by the rotary cam; and an axial positioning block carried by the lower die half;

wherein the receiving block and the axial positioning block have juxtaposed mating concave and convex surfaces which fix the axial position of the rotary cam during forming of the sheet metal work.

3. The die of claim 1, wherein the convex surface is on the receiving block and the concave surface is on the axial positioning block.

4. The die of claim 1, wherein the concave surface is on the receiving block and the convex surface is on the axial positioning block.

* * * * *